United States Patent [19]

Leutwiler

[11] Patent Number: 4,921,035

[45] Date of Patent: May 1, 1990

[54] PROCESS FOR COMPACTING POWDERY MATERIALS

[75] Inventor: Hans Leutwiler, Schaffhausen, Switzerland

[73] Assignee: Georg Fischer AG, Schaffhausen, Switzerland

[21] Appl. No.: 162,316

[22] PCT Filed: Jun. 5, 1987

[86] PCT No.: PCT/CH87/00065

§ 371 Date: Mar. 10, 1988

§ 102(e) Date: Mar. 10, 1988

[87] PCT Pub. No.: WO87/07544

PCT Pub. Date: Dec. 17, 1987

[30] Foreign Application Priority Data

Jun. 13, 1986 [CH] Switzerland ..... 2404/86
Jul. 25, 1986 [CH] Switzerland ..... 2992/86

[51] Int. Cl.[5] ..... B22C 15/00
[52] U.S. Cl. ..... 164/37; 164/7.1
[58] Field of Search ..... 164/37, 7.1, 169, 160.1

[56] References Cited

U.S. PATENT DOCUMENTS 3,807,483 4/1974 Buhler ..... 164/202 X
4,750,540 6/1988 Boenisch ..... 164/37 X

FOREIGN PATENT DOCUMENTS 1097622 7/1961 Fed. Rep. of Germany .
55-147461 11/1980 Japan ..... 164/169
58-125339 7/1983 Japan ..... 164/169
82/03348 10/1982 PCT Int'l Appl. ..... 164/7.1

*Primary Examiner*—Nicholas P. Godici
*Assistant Examiner*—J. Reed Batten, Jr.
*Attorney, Agent, or Firm*—Walter C. Farley

[57] ABSTRACT

A process for compacting powdery materials is initiated by a pressure surge in which a surge $G_1$ acts at a time $t_1$ on the surface of the powdery material and, at the same time, a surge $G_2$ is applied at a time $t_2$ to a region of the material at a distance from the surface in the direction of the pattern so that friction between the sides of the mold housing and the compacting material is reduced. The time relationship is such that the air introduced into the material by surge $G_2$ has time to escape before the surge $G_1$ reaches the pattern plate. For this purpose, openings 9 are provided in the pattern plate between the mold-box wall 3 and pattern 2. These openings can be arranged around the marginal areas of the pattern plate and can vary in size and number depending upon the distance between the wall 3 and pattern 2 or on the shape of the pattern. The openings can be vented to the atmosphere or connected to a suction source.

7 Claims, 1 Drawing Sheet

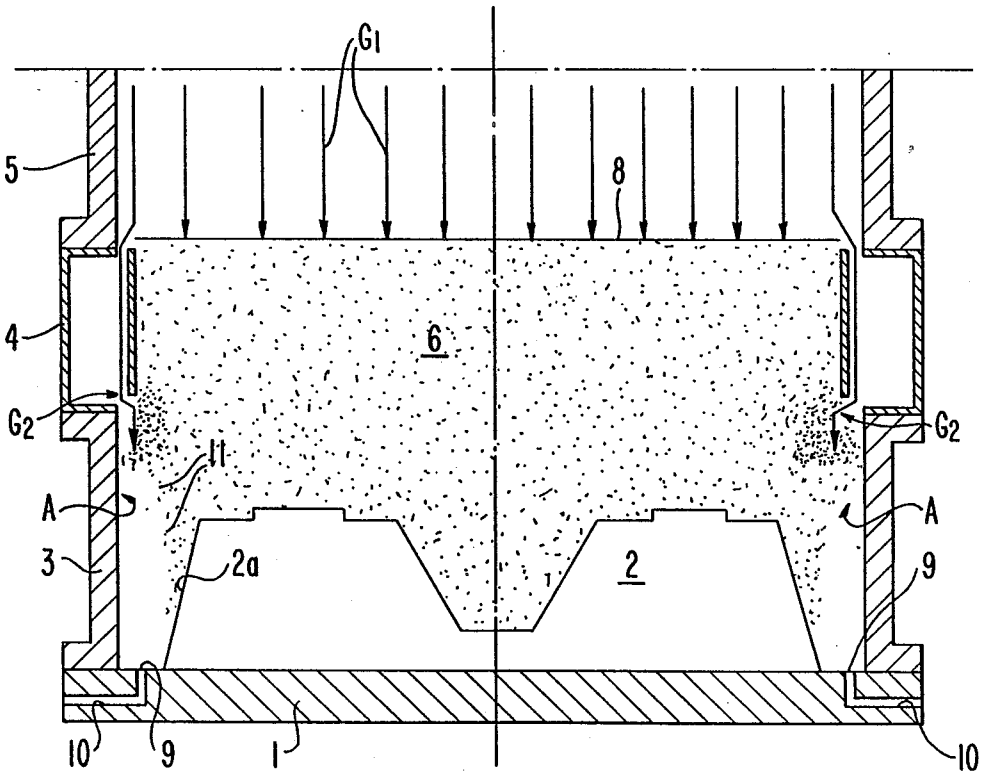
G1
5
4
G2
A
3
10
9
11
2a
1
6
8
2
G2
A
9
10

PROCESS FOR COMPACTING POWDERY MATERIALS

This invention relates to a process for compacting powdery materials, in particular molding materials, by applying pressure to the material which is placed into the molding device having a pattern plate with a pattern thereon, a filling frame and a mold frame placed on top of the pattern plate.

BACKGROUND OF THE INVENTION

Various processes are known for compacting powdery or granular materials for the purpose of manufacturing casting molds made of sand.

U.S. Pat. No. 3,170,202 describes a compacting process which uses gas pressure. A gas mixture is ignited to create an exothermic reaction. The resulting gas pressure then compacts the materials, resulting in a sand mold.

German Patent 1,097,622 describes a compacting process in which the compacting of the materials occurs by releasing the pressure of a highly compressed gas.

Compressed gas molding devices which are used for performing these compacting processes operated exclusively on the principle of acceleration compression. A pressure surge is generated, acting very rapidly on the mass of material, and also accelerating it. Compaction occurs as a result of the compression of the granular or powdery material at the pattern. Ideally, each sand particle is affected by the pressure wave and the absorbed acceleration energy is transferred to each successive powder layer until the pattern is reached. This would result in a uniformly compacted shape with a high degree of hardness, the resulting mold being usable to manufacture precise, high-quality castings.

Clay-like molding powders, which must be transported from the preparation station to the mold box in the manufacturing plant, are most often used for compacting purposes.

When the material mass arrives at the mold box, it is initially not a completely homogenous mass because lumps form during transportation as a result of collisions which cause some compacting. The collisions can be traced to the tendency of the mass to overcome the relative difference in heights which must be overcome during the lengthy transportation to the mold box.

Furthermore, the need for efficient production requires that the pattern plates be occupied to a considerable degree. This leads to the fact that the clearance between the mold box wall and the pattern becomes even smaller. In order to manufacture a usable and high quality mold, however, these interstices which become even smaller must be homogeneously filled with sand. But this is not always possible for the reasons described above so that there is already a predisposition toward undesired bridge-building across these interstices when the matrial mass is poured into the mold box.

When the pressure surge is applied to compact the material mass, the pressure wave takes effect with equal force on the bridge areas. Because the compression forces have a uniform effect on the support areas of the bridges, they are made firmer in their respective positions.

SUMMARY OF THE INVENTION

Accordingly, an object of the present invention is to improve the known processes so that uniformly compacting shapes can be reproduced with a high degree of hardness. In particular, it is important for narrow edge areas to obtain high durability values which are a prerequisite for industrial production. In addition, it is important for efficient operation to be possible within a given, short processing time.

In one aspect, the invention comprises a process for compacting powdery or granular molding material in a molding apparatus including a pattern plate, a pattern on the pattern plate and a filling and forming frame comprising the steps of placing a mass of powdery molding material in the filling and forming frame substantially surrounding the pattern, applying a first pressure surge $G_1$ to the exposed surface of the mass of molding material at a time $t_1$ to place the mass of material into a flow motion in the direction of the pattern, and applying a second pressure surge $G_2$ to at least one surface of the material mass in a direction to influence the material mass area gap such that the pressure surge $G_2$ occurs before or during the effective interval of the pressure surge $G_1$ on the surface of material area A.

In another aspect, the invention comprises an apparatus for compacting powdery molding material using a gas pressure surge in a molding apparatus including a pattern plate, a pattern on the pattern plate and a filling and forming frame substantially surrounding the pattern and defining a cavity for receiving the molding material comprising the combination of means for applying a first pressure surge $G_1$ to the exposed surface of the mass of molding material at a time $t_1$, means for applying a second pressure surge $G_2$ at a time $t_2$ to a material area A having a predetermined separation from the exposed surface of the material mass in the direction of the pattern, and means defining apertures in the pattern plate for removing the pressure medium introduced by the pressure surge $G_2$.

BRIEF DESCRIPTION OF THE DRAWINGS

In order to impart full understanding of the manner in which these and other objects are attained in accordance with the invention, particularly advantageous embodiments thereof will be described with reference to the accompanying drawing, which forms a part of this specification, and which shows a schematic side elevation, in partial section, of a mold apparatus in accordance with the invention with which the method of the invention can be practiced.

DESCRIPTION OF THE PREFERRED EMBODIMENT

As will be recognized from the following, the process of the present invention operates with the conversion of large amounts of compressed air per unit of time whereby pressures in the range of from about 1 to about 10 bar are applied.

The mold box configuration is loosely filled with molding material. The surface 8 of the mass of molding material is essentially level and is within the filling frame 4.

For the purpose of compacting the mass of material, a pressure surge is applied. When the pressure surge is applied, a first pressure surge $G_1$ occurs at a time $t_1$ and is applied to the free material surface and the material mass begins to move back and forth in the direction of the pattern 2, layer-by-layer. A second or further pressure surge $G_2$ is applied to a material area A at a time $t_2$. The surges can be created such that the delay between times $t_1$ and $t_2$ is no greater than 80 milliseconds. This material area A is a part of the filled-in material mass and is located a predetermined distance in the direction of the pattern 2 from the free, exposed surface 8 of the mass of material. Pressure surge $G_2$ is usually applied to the material surface in material area A prior to pressure surge $G_1$ taking effect. However, it is also possible to apply surge $G_2$ after the pressure surge $G_1$ has already been applied to material area A.

Pressure surges $G_1$ and $G_2$ can be derived from one and the same pressure source. Alternatively, they can be applied independently of each other from different pressure sources.

When pressure surge $G_1$ is applied to the free material surface 8, the upper layer of the material mass is compacted, i.e., pressed together. This compaction occurs suddenly so that the compacted area moves, somewhat in the manner of a wave, in the direction of the pattern as a result of the suddenly applied pressure. Pressure surge $G_2$ arrives at the material mass in material area A, i.e., at a specified distance from the free material surface 8. The material area A is influenced by the pressure surge as to its flow behavior. The sand particles in this material area A are pressed away from the mold box wall so that the friction between the sand particles and the mold box wall is nearly eliminated.

When pressure surge $G_2$ is applied, the $G_1$ pressure surge can then arrive at the surface of the material mass. When $G_1$ is taking effect, the material mass is displaced in a compacting motion. As a result of this compacting motion, the material area A is also set in motion and shifted in the direction of the surface of the pattern. This shift endures until surge $G_1$ catches up to the affected area of the $G_2$ pressure surge.

While pressure surge $G_2$ is taking effect, the friction between the mold box wall and the material is almost eliminated along the contact area of the material mass which is in motion due to the effect of the $G_1$ pressure surge. The duration of the $G_2$ pressure surge represents the time required for the $G_1$ and $G_2$ surges to compensate for pressure, i.e., until the $G_1$ pressure wave arrives at the material area A or the effective area of $G_2$.

In order to adjust the effect of pressure surges $G_1$ and $G_2$ optimally with respect to each other, a difference in the effective time of the two pressure surges of a maximum of 195 ms has been shown to be expedient for a mold box height size, for example, of 1000 mm. Good results were also achieved in experiments in which the pressure surge $G_2$ was introduced about 5 seconds before pressure surge $G_1$ to the material.

As a result of the steps described above, which lead to reduction in the friction between the sand particles and the mold box wall, the flow capacity of the material mass is influenced directly which, in turn, has a direct effect on the compacting capacity on the material mass. The prerequisite for good compacting is good flow capacity which only results if the material mass exists in a more or less homogenous state.

The illustration shows a cross-section of a mold device. The pattern 2 is placed on a pattern plate 1. Pattern 2 is surrounded by a mold frame 3 and filling frame 4 is positioned on the mold frame to form a mold box. A compression chamber, not fully shown in the figure, is indicated by wall 5. A series of apertures 9 through pattern plate 1 have openings positioned between the mold box wall 3 and pattern 2. Prior to the compacting procedure, the region around and above the pattern is substantially filled with molding sand 6.

When the compacting procedure is initiated, a pressure surge $G_1$ is activated at time $t_1$ at the surface 8 of the material. At time $t_2$ pressure surge $G_2$ appears on the mold sand in material A. Because at time $t_2$ the material in area A is not compacted, this area is fluidized and moves as a mass in the direction of the pattern plate along with the pressure wave front caused by pressure surge $G_1$ also moving in the direction of pattern plate.

The additional amount of air inserted into material area A is removed through apertures 9 when it reaches the pattern plate 1. The removed air can be removed from the molding system by means of canals 10 which can be vented to the surrounding atmosphere.

The additional amount of air is extracted from the material mass in the molding area during the effective duration of pressure surge $G_1$ because air captured in a material mass would be compressed when the material mass is compacted which would prevent the uniform compaction of material at that location which, as already mentioned, would lead to poor quality of the mold shape. The apertures 9 are incorporated to overcome this problem and serve to extract excess air which has been displaced by the material mass. The pressure existing in conduits 10 can be made lower than that of the surrounding pressure by suction means, causing a suction effect which enhances the removal of additional amounts of air from the material mass from that area between the pattern box wall 3 and model 2.

Apertures 9 are advantageously positioned along the pattern box wall in the model plate. Depending upon the clearance from the pattern box wall 3 to the model 2, and depending upon the degree of complexity of the pattern, the apertures can be positioned closer to each other and the diameters thereof can be varied. It is, in any event, important that the apertures be positioned in the area of the vertical projection on the pattern plate of the effective range 11 of pressure surge $G_2$. Experiments hve shown that a desirable result occurs if the sum of the total areas of the apertures 9 is equal to at least 1% of the exposed pattern plate surface area between mold box 3 and model wall 2A.

The process according to the invention assures that in the critical material areas, that is, between the pattern and the mold box, the compacting capacity of the material mass is maximized by improved flow behavior by reducing the friction between the material mass and the mold box wall.

While certain advantageous embodiments have been chosen to illustrate the invention, it will be understood by those skilled in the art that various changes and modifications can be made therein without departing from the scope of the invention as defined in the appended claims.

What is claimed is:

1. A process for compacting powdery molding material in a molding apparatus including a pattern plate, a pattern on the pattern plate and a filling and forming frame comprising placing a mass of powdery molding material in the filling and forming frame substantially surrounding the pattern, applying a first gaseous medium pressure surge $G_1$ to the exposed surface of the mass of molding material at a time $t_1$ to cause the mass of material to flow in the direction of the pattern, and applying a second gaseous medium pressure surge $G_2$ at a time $t_2$ to at least one surface (A) of the material mass spaced from said exposed surface in the direction of the pattern, wherein the delay between $t_1$ and $t_2$ is no greater than 80 milliseconds such that the pressure surge $G_2$ impinges upon said at least one surface (A) before or during the active interval of the pressure surge $G_1$ on said exposed surface of the material.

2. A process according to claim 1 wherein pressure surge $G_2$ is applied to the material surface no more than 195 milliseconds after pressure surge $G_1$ and is maintained until pressure surge $G_1$ reaches the material area A of pressure surge $G_2$.

3. A process accoding to claim 2 wherein the effective duration of pressure surge $G_2$ is variable.

4. A process according to claim 2 wherein the pressure of pressure surge $G_2$ is varied during the interval of application thereof.

5. A process according to claim 4 wherein the pressure surge $G_2$ is applied in a pulsating fashion.

6. A process according to claim 2 wherein the pressure of pressure surge $G_2$ is maintained for a predetermined interval of time during the compacting procedure.

7. A process for compacting molding material in a molding apparatus including a pattern plate, a pattern on the pattern plate and a filling and forming frame comprising placing a mass of molding material in the filling and forming frame substantially surrounding the pattern, applying a first gaseous medium pressure surge $G_1$ to the exposed surface of the mass of molding material at a time $t_1$ to cause the mass of material to flow in the direction of the pattern, and applying a second gaseous medium pressure surge $G_2$ no more than 5 seconds before pressure surge $G_1$ to at least one surface (A) of the material mass spaced from said exposed surface in the direction of the pattern and maintaining the pressure surge $G_2$ until pressure surge $G_1$ has reached material area (A) of pressure surge $G_2$.

* * * * *